United States Patent [19]

Suemitsu et al.

[11] Patent Number: 4,548,685

[45] Date of Patent: Oct. 22, 1985

[54] PROCESS FOR ELECTROLYTICALLY REMOVING METAL DEPOSIT FROM A NON-PLATED SURFACE OF A SINGLE SURFACE-PLATED METAL STRIP

[75] Inventors: Yukimasa Suemitsu; Kazutsugu Nakajima; Ryoichi Naka; Hiroo Goshi, all of Tokai, Japan

[73] Assignee: Nippon Steel Corporation, Tokyo, Japan

[21] Appl. No.: 643,451

[22] Filed: Aug. 23, 1984

[30] Foreign Application Priority Data

Sep. 2, 1983 [JP] Japan ..... 58-160397

[51] Int. Cl.[4] ..... C25F 5/00

[52] U.S. Cl. ..... 204/146; 204/DIG. 7

[58] Field of Search ..... 204/146, DIG. 7

[56] References Cited

U.S. PATENT DOCUMENTS

| | | | |
|---|---|---|---|
| 3,959,099 | 5/1976 | Froman | 204/146 |
| 3,970,537 | 7/1976 | Froman | 204/DIG. 7 |
| 3,988,216 | 10/1976 | Austin | 204/DIG. 7 |
| 4,464,232 | 8/1984 | Wakano | 204/146 |

*Primary Examiner*—T. M. Tufariello

*Attorney, Agent, or Firm*—Kenyon & Kenyon

[57] ABSTRACT

In a process for electrolytically removing metal deposit from a non-plated surface of a single surface-plated metal strip, by bringing, within an electrolytic liquid, a single surface-plated metal strip which serves as an anode plate, into a location at which the non-plated surface of the anode single surface-plated metal strip faces in parallel to and is spaced from a cathode plate, and by applying a principal voltage between the anode metal strip and said cathode plate to electrolytically remove metal deposit from the non-plated surface; whereby undesirable stripping of portions of the plated metal layer in side edge portions of the plated surface of the metal strip is prevented by arranging supplementary anode plates within the electrolytic liquid in such a manner that the supplementary anode plates face in parallel to and are spaced from side edge portions of the plated surface of the anode metal strip, and then, while the principal voltage is applied between the anode metal strip and the cathode plate, a supplementary voltage is applied between the supplementary anode plates and the metal strip, the electric potential of each supplementary anode plate being higher than that of the metal strip.

4 Claims, 3 Drawing Figures

PROCESS FOR ELECTROLYTICALLY REMOVING METAL DEPOSIT FROM A NON-PLATED SURFACE OF A SINGLE SURFACE-PLATED METAL STRIP

BACKGROUND OF THE INVENTION

1. Field of the Invention

The present invention relates to a process for electrolytically removing metal deposit from a non-plated surface of a single surface-plated metal strip.

More particularly, the present invention relates to an improved process for electrolytically removing metal deposit from a non-plated surface of a single surface-plated metal strip while preventing the undesirable stripping of portions of a plating layer on the plated surface of the single surface-plated steel strip.

2. Description of the Prior Art

When a metal strip, for example, a steel strip is single surface-plated with a metal in an electrolytic plating liquid, usually the non-plated surface of the metal strip is undesirably soiled with metal deposits. Although sometimes the metal deposit on the non-plated surface is intentionally produced so that the non-plated surface is protected from electrolytic etching by the electrolytic plating liquid.

Whether undesirably or intentionally produced, the metal deposit must be removed from the non-plated surface of the metal strip by means of an electrolytic treatment.

When the metal deposit is removed by means of an electrolytic treatment, it is found that portions of plated metal layer located at side edge portions of the plated surface of the metal strip are stripped in the form of continuous belts extending along the side edges of the metal strip.

This undesirable stripping of the plated metal layer renders the metal strip useless for commercial purposes.

However, there is, as yet, no effective method for satisfactorily preventing the undesirable stripping of the plated metal layer.

SUMMARY OF THE INVENTION

An object of the present invention is to provide a process for electrolytically removing metal deposit from a non-plated surface of a single surface-plated metal strip while preventing undesirable stripping of portions of the plated metal layer at side edge portions of the plated surface of the metal strip.

The above-mentioned object can be attained by the process of the present invention which comprises bringing, within an electrolytic liquid, a single surface-plated metal strip which serves as an anode plate, into a location at which the non-plated surface of the anode single surface-plated metal strip faces in parallel to and is spaced from a cathode plate; applying a principal voltage between the anode metal strip and the cathode plate to electrolytically remove metal deposit from the non-plated surface; which process is characterized in that supplementary anode plates are arranged, within the electrolytic liquid, in locations such that the supplementary anode plates face in parallel to and are spaced from side edge portions of the plated surface of the anode metal strip; and then, while the principal voltage is applied between the anode metal strip and the cathode plate, a supplementary voltage is applied between the supplementary anode plates and the metal strip, the electric potential of the supplementary anode plate being higher than that of the metal strip, thereby preventing undesirable stripping of portions of the plated metal layer at the side edge portions of the plated surface.

DESCRIPTION OF THE PREFERRED EMBODIMENT

After a surface of a metal strip, for example, a steel strip, is single surface-plated with a metal in an electrolytic plating liquid, undesirable deposits of the metal produced on the non-plated opposite surface of the metal strip can be removed by means of an electrolytic treatment.

Figure 1:
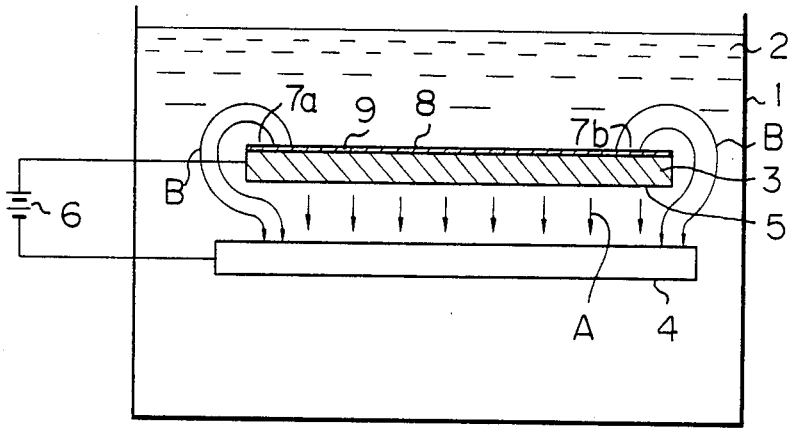
Fig. 1 PRIOR ART
FIG. 1 is an explanatory cross-sectional view of a conventional electrolytic apparatus for removing metal deposit from a non-plated surface of a single surface-plated metal strip.
Figure 2:
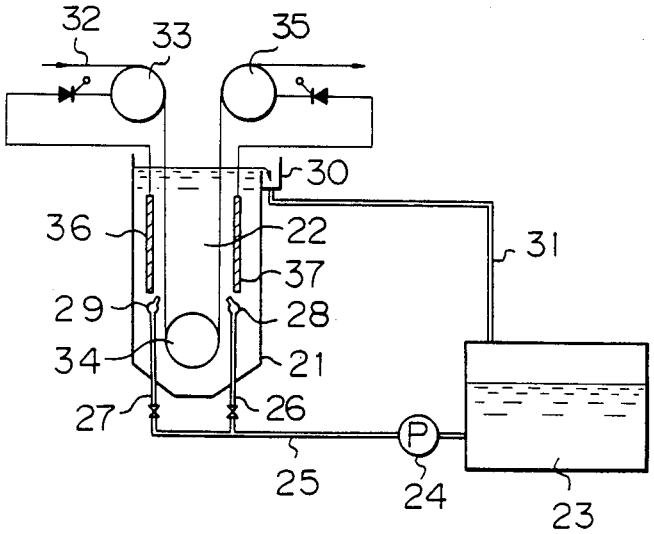
Fig. 2 PRIOR ART
FIG. 2 is an explanatory cross-sectional view of a conventional electrolytic apparatus for continuously removing metal deposit from a non-plated surface of a single surface-plated metal strip.

This electrolytic treatment can be carried out by using a conventional electrolytic apparatus, for example, as shown in FIGS. 1 and 2.

Referring to FIG. 1, an electrolytic treatment vessel 1 contains an electrolytic liquid 2. In the electrolytic liquid 2, a single surface-plated metal strip 3 and a cathode plate 4 are arranged so that a non-plated surface 5 of the metal strip 3 faces in parallel to and is spaced from the cathode plate 4. The metal strip 3 serves as an anode. A voltage is then applied from an electric source 6 between the anode metal strip 3 and the cathode plate 4 so as to remove metal deposit on the non-plated surface 5.

This electrolytic treatment can be continuously carried out by a conventional apparatus, for example, as shown in FIG. 2.

Referring to FIG. 2, a vessel 21 contains an electrolytic liquid 22 which is supplied from a electrolytic liquid tank 23 through a pump 24, conduits 25, 26, and 27, and, nozzles 28 and 29. A portion of the electrolytic liquid 22 overflows from the vessel 21 and is recycled into the tank 23 through an overflow through 30 and conduit 31. A metal strip 32 is introduced into the vessel 21 through a guide roll 33, moves through a guide roll 34, and is withdrawn from the vessel 21 through a guide roll 35. Within the electrolytic liquid 22, two cathode plates 36 and 37 are arranged at a location such that the cathode plates 36 and 37 face in parallel to and are spaced from a non-plated surface of the metal strip 32. A voltage is applied to between the metal strip 32 and the cathode plates 36 and 37 through the guide rolls 33 and 35 which are in contact with the metal strip 32.

Returing to FIG. 1, when voltage is applied between the metal plate 3 and the cathode plate 4, electric current is produced in the direction indicated by arrow A and undesirable metal deposit on the non-plated surface 5 is electrolytically removed.

However, in the above-mentioned electrolytic treatment, around the side edge portions *7a* and *7b* of the metal strip 3, curved swirl currents indicated by arrow B are produced between the side edge portions *7a* and 7b of the plated surface 8 of the metal strip 3 and the cathode plate 4. These swirl currents B cause portions of the plated metal layer 9 located at the side edge portions 7a and 7b of the plated surface 8 to strip-off in the form of continuous belts extending along the side edges of the metal strip 3.

The above-mentioned creation of the undesirable swirl currrents can be prevented by the process of the present invention.

In the process of the present invention, supplementary anode plates are arranged in the electrolytic liquid in such a manner that each of the supplementary anode plates faces in parallel to and is spaced from the corresponding side edge portion of the plated surface of the single surface-plated metal strip, and then while a principal voltage is applied between the anode metal strip and the cathode plate, a supplementary voltage is applied between each supplementary anode plate and the metal strip, the supplementary anode plate having a higher electric potential than that of the metal strip.

Figure 3:
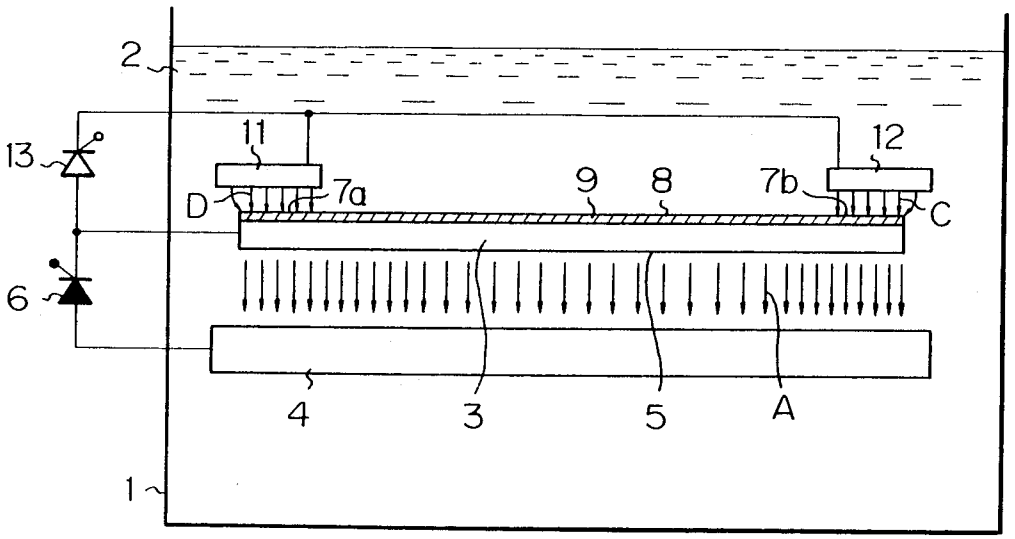
FIG. 3 is an explanatory partial cross-section view of an electrolytic apparatus for practicing the process of the present invention.

Referring to FIG. 3, a vessel 1 contains an electrolytic liquid 2. Within this electrolytic liquid 2, a single surface-plated metal strip 3 and a cathode plate 4 are arranged in a relationship to each other such that the non-plated surface 5 of the metal strip 3 is in parallel to and faces the cathode plate 4 in such a manner as to form a space therbetween. The cathode plate 4 is preferably made from a material insoluble in the electrolytic liquid used.

Supplementary anode plates 11 and 12 are arranged in such a manner that the supplementary anode plates 11 and 12 face and are spaced from side edge portions 7a and 7b of the plated surface 8 of the metal strip 3 in parallel to each other, as indicated in FIG. 3.

In the electrolytic treatment in accordance with the present invention, while a principal voltage is applied from an electric source 6 between the metal strip 3 and the cathode plate 4, a supplementary voltage is applied from an electric source 13 between the supplementary anode plates 11 and 12 and the cathode plate 4. It is important that the electric potential of each supplementary anode plate be maintained higher than that of the metal strip. The principal voltage causes an electric current to pass between the non-plated surface 5 of the metal strip 3 and the cathode plate 4 in the direction indicated by arrow A, so as to remove metal deposits from the non-plated surface 5.

Also, a supplementary voltage creates supplementary electric currents flowing between the additional anode plates 11 and 12 and the side edge portions 7a and 7b of the plated surface 8 of the metal strip 3 in the direction indicated by arrows C and D. These currents C and D are effective for preventing the creation of undesirable swirl currents around the side edge portions 7a and 7b of the metal strip 3 and therefore, for preventing stripping of portions of the plated metal layer 9 located at the side edge portions of the plated surface 8.

In the process of the present invention, the electrolytic liquid contains at least one electrolyte, for example, $NaH_2PO_4.2H_2O$.

The principal voltage causes a principal electric current to be produced preferably in a current density of 30 to 100 A/dm$^2$, between the non-plated surface of the metal strip 3 and the cathode plate 4. Also, the supplementary voltage causes a supplementary electric current to be produced preferably in an entire current of 150 to 300 A.

The principal voltage is adjusted so as to create a principal current having a current with the density necessary for completely removing the metal deposit from the non-plated surface of the metal strip 3. Also, the supplementary voltage is controlled, in response to the necessary current density of the principal current, to a value that will produce the necessary entire current for preventing the creation of undesirable swirl currents around the side edge portions 7a, 7b of the metal strip; the intensity of the swirl currents depending upon the value of the principal current density applied.

The electrolytic treatment in accordance with the present invention is carried out preferably at a temperature of from 10° C. to 70° C. for 0.5 seconds to 5 seconds.

Examples of the present invention and comparative examples will be described hereinafter.

EXAMPLE 1

A single surface-plated steel strip with a plated surface thereof having 23 g/m$^2$ of a plated zinc layer and a non-plated surface thereof having 0.5 g/m$^2$ of zinc deposit. The metal strip was moved at a velocity of 100 m/min through an electrolytic liquid containing 200 g/l of $NaH_2PO_4$ and having a pH of 5 and a temperature of 40° C., in such a manner that the non-plated surface of the steel strip is in parallel to and faces a cathode plate having a length of 1500 mm and is spaced 25 mm from the cathode plate, and two supplementary anode plates each having a length of 1500 mm were arranged so that the supplementary anode plates face the side edge portions having a width of 15 mm of the plated surface of the steel strip and are spaced 10 mm from the plated surface.

A principal voltage of 40 volts was applied between the cathode plate and the steel strip so as to produce an electric current at a current density of 35 A/dm$^2$ between them. Separately, a supplementary voltage of 18 volts was applied between the supplementary anode plates and the metal strip so as to create 200 A of an entire current between them.

After 2 seconds of the electrolytic treatment, it was found that the metal deposit was completely removed from the non-plated surface of the steel strip. During the electrolytic treatment, no stripping of the plated zinc layer on the plated surface occurred at the side edge portions of the steel strip.

EXAMPLE 2

The same procedures as those described in Example 1 were applied to a single surface-plated steel strip with a plated surface thereof having 23 g/m$^2$ of a plated alloy layer consisting of 10 parts by weight of iron and 90 parts by weight of zinc, and a non-plated surface thereof soiled with 0.5 g/m$^2$ of metal deposit consisting of 10 parts by weight of iron and 90 parts by weight of zinc.

After the electrolytic treatment was completed, it was found that the Fe-Zn alloy deposit was completely removed from the non-plated surface and the plated Fe-Zn alloy layer on the plated surface was maintained without being stripped.

EXAMPLE 3

A surface of a steel strip was electrolytically plated with a base alloy layer consisting of 15 parts by weight of iron and 85 parts by weight of iron, and then with an upper alloy layer consisting of 85 parts by weight of iron and 15 parts by weight of zinc, the sum of the weights of the base and upper alloy layer being 23 g/m$^2$. The non-plated surface of the steel strip was soiled with 0.6 g/m$^2$ of metal deposit consisting of 20 parts by weight of iron and 80 parts by weight of zinc.

The same electrolytic treatment as that described in Example 1 was applied to the above-mentioned single surface-plated steel strip, except that the principal currnet density was 60 A/dm$^2$, the entire supplementary current was 240 A, and the width of each side edge portion of the plated surface of the steel strip, which portion faced in parallel to each corresponding supplementary anode plate, was 20 mm.

The metal deposit on the non-plated surface was completely removed without stripping the plated metal layer from the plated surface of the steel strip.

EXAMPLE 4

The same procedures as those described in Example 3 were carried out except that the amount of the metal deposit was 0.7 g/m$^2$, the principal current density was 100 A/dm$^2$, entire supplementary current was 280 A, and the width of the side edge portion of the metal strip to which the supplementary current was applied was 25 mm.

The metal deposit was completely removed from the non-plated surface, without stripping the plated metal layer on the plated surface of the steel strip.

EXAMPLE 5

The same procedures as those described in Example 3 were carried out except that the amount of the metal deposit on the non-plated surface was 0.3 g/m$^3$, the principal current density was 30 A/dm$^2$, the entire supplementary current was 150 A, and the width of each side edge portion of the plated surface to which the supplementary current was applied, was 100 mm.

The metal deposit was completely removed from the non-plated surface of the steel strip without stripping the plated metal layer from the plated surface of the steel strip.

COMPARATIVE EXAMPLE 1

The same procedures as those described in Example 1 were carried out except that no supplementary voltage was applied between the supplementary anode plates and the metal strip.

The metal deposit was completely removed. However, in each side edge portion of the plated surface, a portion of the plated metal layer located 100 mm inwards from the side edge of the steel strip was stripped in the form of a belt having a width of 5 mm and extending along the side edge of the steel strip.

COMPARATIVE EXAMPLE 2

The same procedures as those described in Example 1 were carried out except that the supplementary anode plates were moved outward from the steel strip so that the supplementary anode did not face the plated surface of steel strip.

After the electrolytic treatment was completed, it was found that the metal deposit was completely removed from the non-plated surface of the steel strip.

However, in each side edge portion of the plated surface of the steel strip, a portion of the plated metal layer located 130 mm inward from the side edge of the steel strip was stripped in the form of a belt having a width of 7 mm and extending along the side edge of the steel strip.

We claim:

1. A process for electrolytically removing metal deposit from a non-plated surface of a single surface-plated metal strip, comprising;

bringing, within an electrolytic liquid, a single surface-plated metal strip which serves as an anode plate, into a location at which the non-plated surface of said anode single surface-plated metal strip faces in parallel to and is spaced from a cathode plate, and applying a principal voltage between said anode metal strip and said cathode plate and electrolytically removing metal deposit from said non-plated surface;

which process is characterized in that said electrolytic liquid consists of an aqueous solution containing $NaH_2PO_4.2H_2O$ and a pair of supplementary anode plates are arranged, within said electrolytic liquid, in locations such that said supplementary anode plates face in parallel to and are spaced from side edge portions of the plated surface of said anode metal strip, and, while the principal voltage is applied between said anode metal strip and said cathode plate, a supplementary voltage is applied between said supplementary anode plates and said metal strip, the electric potential of said supplementary anode plates being higher than that of said metal strip, thereby preventing undersirable stripping of portions of the plated metal layer in said side edge portions of said plated surface.

2. The process as claimed in claim 1, wherein the principal voltage applied between said anode metal strip and said cathode plate causes a principal electric current to be created at a current density of from 30 to 100 A/dm$^2$.

3. The process as claimed in claim 1, wherein the supplementary voltage applied between said supplementary anode plates and said metal strip results in the creation of a supplementary electric current of from 150 to 300 A.

4. The process as claimed in claim 1, wherein said metal strip is a steel strip.

* * * * *

UNITED STATES PATENT AND TRADEMARK OFFICE

CERTIFICATE OF CORRECTION

PATENT NO. : 4,548,685

DATED : October 22, 1985

INVENTOR(S) : Y. Suemitsu et al.

It is certified that error appears in the above-identified patent and that said Letters Patent is hereby corrected as shown below:

Column 2, line 45, change "a electrolytic" to --an electrolytic--.

Column 2, line 60, change "Returing" to --Returning--.

Column 3, line 27, change "therbetween" to --therebetween--.

Column 3, line 61, change "$NaH_2PO_4.2H_2O$." to --$NaH_2PO_4 \cdot 2H_2O$.--

Column 5, line 8, change "net density" to --ent density--.

Column 5, line 41, center "COMPARATIVE EXAMPLE 1" over following paragraph.

Column 6, line 3, change "of steel" to --of the steel--.

UNITED STATES PATENT AND TRADEMARK OFFICE

CERTIFICATE OF CORRECTION

PATENT NO. : 4,548,685

DATED : October 22, 1985

INVENTOR(S) : Y. Suemitsu et al.

It is certified that error appears in the above-identified patent and that said Letters Patent is hereby corrected as shown below:

Column 6, line 29, change "$NaH_2PO_4.2H_2O$" to --$NaH_2PO_4 \cdot 2H_2O$--.

Column 6, line 40, change "undersirable" to --undesirable--.

Signed and Sealed this

*Fifteenth* Day of *April 1986*

[SEAL]

*Attest:*

DONALD J. QUIGG

*Attesting Officer*

*Commissioner of Patents and Trademarks*